US008725019B2

(12) United States Patent
Kubota

(10) Patent No.: US 8,725,019 B2
(45) Date of Patent: May 13, 2014

(54) FIXING DEVICE, FIXING DEVICE CONTROL METHOD, AND IMAGE FORMING APPARATUS

(75) Inventor: Keisuke Kubota, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 38 days.

(21) Appl. No.: 13/137,736

(22) Filed: Sep. 8, 2011

(65) Prior Publication Data

US 2012/0087688 A1 Apr. 12, 2012

(30) Foreign Application Priority Data

Oct. 8, 2010 (JP) ..... 2010-228167

(51) Int. Cl.
*G03G 15/20* (2006.01)

(52) U.S. Cl.
USPC ..... 399/69; 399/67; 399/68

(58) Field of Classification Search
USPC ..... 399/67, 68, 69
See application file for complete search history.

(56) References Cited

U.S. PATENT DOCUMENTS

| | | | | |
|---|---|---|---|---|
| 6,055,390 | A | 4/2000 | Kurotaka et al. | |
| 6,198,888 | B1 | 3/2001 | Kurotaka et al. | |
| 6,397,021 | B2 * | 5/2002 | Hayashi et al. | 399/69 |
| 7,548,718 | B2 | 6/2009 | Kubota et al. | |
| 7,567,766 | B2 * | 7/2009 | Miyata et al. | 399/69 |
| 7,792,451 | B2 * | 9/2010 | Kim et al. | 399/69 |
| 7,945,198 | B2 | 5/2011 | Mitsuya et al. | |
| 8,195,058 | B2 * | 6/2012 | Takenaka et al. | 399/69 |
| 2004/0004071 | A1 | 1/2004 | Ogasawara et al. | |
| 2004/0223795 | A1 | 11/2004 | Ono et al. | |
| 2007/0092277 | A1 | 4/2007 | Miyata et al. | |
| 2007/0196120 | A1 | 8/2007 | Maeda | |
| 2007/0237554 | A1 | 10/2007 | Mitsuya et al. | |
| 2008/0013995 | A1 | 1/2008 | Kubota et al. | |
| 2008/0170896 | A1 | 7/2008 | Kubota et al. | |

(Continued)

FOREIGN PATENT DOCUMENTS

| | | |
|---|---|---|
| CN | 1202641 | 12/1998 |
| CN | 1455304 | 11/2003 |

(Continued)

OTHER PUBLICATIONS

Abstract of JP 2005-242189 published Sep. 8, 2005.

(Continued)

*Primary Examiner* — David Gray
*Assistant Examiner* — Michael Harrison
(74) *Attorney, Agent, or Firm* — Harness, Dickey & Pierce, P.L.C.

(57) ABSTRACT

A fixing device includes a heat roller, a heater, a fuser roller, an endless, fuser belt, a pressure roller, a first thermometer, and a controller. The heat roller has a surface thereof subjected to heating. The heater is disposed in the heat roller to heat the circumference of the heat roller to an adjustable, heating temperature. The fuser roller is disposed parallel to the heat roller and has a surface thereof formed of elastic material deposited upon a cylindrical core of metal. The fuser belt is looped for rotation around the fuser roller and the heat roller. The pressure roller is disposed opposite the fuser roller with the fuser belt interposed between the pressure roller and the fuser roller. The first thermometer detects a first temperature at the cylindrical core of the fuser roller. The controller adjusts the heating temperature according to the first temperature being detected.

19 Claims, 6 Drawing Sheets

(56) References Cited

U.S. PATENT DOCUMENTS

| | | | |
|---|---|---|---|
| 2008/0279576 | A1 | 11/2008 | Kim et al. |
| 2009/0274477 | A1 | 11/2009 | Okamoto et al. |
| 2009/0274494 | A1 | 11/2009 | Okamoto et al. |
| 2009/0274495 | A1 | 11/2009 | Okamoto et al. |
| 2009/0274496 | A1 | 11/2009 | Okamoto et al. |
| 2009/0274497 | A1 | 11/2009 | Okamoto et al. |
| 2009/0274498 | A1 | 11/2009 | Okamoto et al. |
| 2009/0317155 | A1 | 12/2009 | Murakami et al. |
| 2012/0189361 | A1 | 7/2012 | Murakami et al. |

FOREIGN PATENT DOCUMENTS

| | | | |
|---|---|---|---|
| CN | 1517816 | | 8/2004 |
| CN | 101025600 | | 8/2007 |
| CN | 101303558 | | 11/2008 |
| CN | 101609290 | | 12/2009 |
| JP | 57-122467 | | 7/1982 |
| JP | 09-106214 | | 4/1997 |
| JP | 3629672 | B2 | 1/1999 |
| JP | 4262119 | B2 | 9/2005 |
| JP | 2008-164912 | | 7/2008 |
| JP | 2010152402 | A | 7/2010 |

OTHER PUBLICATIONS

Abstract of JP 2010-152402 published Jul. 8, 2010.
Abstract of JP 11-024484 published Jan. 29, 1999.
Office Action dated Dec. 4, 2013 for corresponding Chinese patent application No. 201110303878.9.
Office Action for corresponding Japanese patent application No. 2010-228167 dated Feb. 12, 2014.

* cited by examiner

FIXING DEVICE, FIXING DEVICE CONTROL METHOD, AND IMAGE FORMING APPARATUS

CROSS-REFERENCE TO RELATED APPLICATIONS

This patent application claims priority pursuant to 35 U.S.C. §119 to Japanese Patent Application No. 2010-228167, filed on Oct. 8, 2010, the entire disclosure of which is hereby incorporated by reference herein.

BACKGROUND OF THE INVENTION

1. Field of the Invention

The present invention relates to a fixing device, a fixing device control method, and an image forming apparatus, and more particularly, to a fixing device that fixes a toner image in place on a recording medium with heat and pressure, a method of heating control for use in such a fixing device, and an electrophotographic image forming apparatus incorporating a fixing device with a heating control capability.

2. Description of the Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and setting the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image onto the medium under heat and pressure.

One such type of fixing device includes a roller-based fuser assembly that employs a fuser roller equipped with an internal heater to heat its circumference to a given process temperature. The fuser roller is paired with a pressure roller pressed against the outer circumference of the fuser roller to form a fixing nip therebetween, at which a toner image is fixed in place with heat from the fuser roller and pressure from the pressure roller.

Another type of fixing device includes a multi-roller, belt-based fuser assembly that employs an endless, flexible fuser belt entrained around multiple rollers, one of which is a fuser roller having a circumference thereof formed of elastic material, and another of which is a heat roller having a circumference thereof subjected to heating to in turn heat the length of the fuser belt rotating therearound. The fuser belt is paired with a pressure roller pressed against the fuser roller via the fuser belt to form a fixing nip therebetween, at which a toner image is fixed in place with heat from the fuser belt and pressure from the pressure roller.

The inventor has recognized that those types of fixing device experience varying environmental and operational conditions during operation, which can cause dimensional variations in the fixing members, in particular, the fuser and pressure members forming a fixing nip therebetween, leading to variations in fixing performance with which a toner image is processed through the fixing nip.

For example, in a belt-based fixing device employing a fuser belt entrained around a motor-driven, rubber-covered fuser roller, a cumulative amount of heat and pressure applied to the recording medium conveyed at a constant speed through the fixing nip is influenced by changes in the operating temperature which cause the elastic material of the fuser roller to thermally expand and contract.

Specifically, a higher operating temperature causes thermal expansion of the fuser roller to increase the length and depth to which the fuser roller engages the pressure roller, resulting in an increased amount of heat and pressure applied to the recording medium during passage through the fixing nip. Contrarily, a lower operating temperature causes thermal contraction of the fuser roller to decrease the length and depth to which the fuser roller engages the pressure roller, resulting in a decreased amount of heat and pressure applied to the recording medium during passage through the fixing nip.

Since good melting and fusion of toner to the recording medium depends on consistent application of a sufficient amount of heat and pressure through the fixing nip, variations in the fixing nip, in particular, a reduction in heat and pressure applied to the recording medium, adversely affect performance of a fixing device. In general, an excessively low operating temperature causes significant defects in a resulting image due to insufficient heating through the fixing nip, which tends to occur where printing is performed under non-steady state conditions, e.g., immediately upon power-on, using a fixed operating temperature originally designed for steady state conditions. On the other hand, fixing performance improves with increasing operating temperature causing thermal expansion of the fuser roller, insofar as the operating temperature is maintained within a normal, appropriate range.

Although thermally-induced variations in the fixing nip are also experienced by a roller-based fixing device as well, the resulting effects on fixing performance are more pronounced in the belt-based design than in the roller-based design, since the former typically employs a thick rubber-covered fuser roller with no dedicated heater provided therein (particularly in applications for high-speed color printers), which is highly prone to dimensional variations due to changes in the operating temperature.

To date, various methods have been proposed to provide a fixing process controllable against changes in environmental and operational conditions.

For example, the image forming apparatus may be given a feedback controller to control heating in a fixing device based on a temperature detected during operation. The image forming apparatus includes a thermometer disposed downstream from a fixing nip to detect temperature of a recording medium passing through the fixing nip. The temperature of the recording medium detected by the thermometer, which is assumed to indicate an amount of heat present in a fuser roller, is fed back to the controller, which accordingly adjusts a fixing temperature with which another, succeeding recording medium is processed through the fixing nip.

Alternatively, an image forming apparatus may employ a feedback controller to control pressure in a fixing nip based on a temperature and humidity detected during operation. The image forming apparatus includes an environment sensor or hygro-thermometer to detect temperature and humidity adjacent to the fixing nip, as well as an additional, auxiliary thermometer to detect temperature at a circumference of a pressure roller. The temperature and humidity detected by the sensors are fed back to the controller, which accordingly control a biasing mechanism that presses the pressure roller against a fuser member to establish the fixing nip therebetween.

BRIEF SUMMARY OF THE INVENTION

Exemplary aspects of the present invention are put forward in view of the above-described circumstances, and provide a novel fixing device.

In one exemplary embodiment, the fixing device includes a heat roller, a heater, a fuser roller, an endless, fuser belt, a pressure roller, a first thermometer, and a controller. The heat roller has a surface thereof subjected to heating. The heater is disposed in the heat roller to heat the surface of the heat roller to an adjustable, heating temperature. The fuser roller is disposed parallel to the heat roller and has a surface thereof formed of elastic material deposited upon a cylindrical core of metal. The fuser belt is looped for rotation around the fuser roller and the heat roller. The pressure roller is disposed opposite the fuser roller with the fuser belt interposed between the pressure roller and the fuser roller. The pressure roller presses against the fuser roller via the fuser belt to form a fixing nip therebetween, through which a recording medium is conveyed under heat and pressure as the fuser roller and the pressure roller rotate together. The first thermometer is disposed adjacent to the fuser roller to detect a first temperature at the cylindrical core of the fuser roller. The controller is operatively connected with the heater and the first thermometer to adjust the heating temperature according to the first temperature being detected.

Other exemplary aspects of the present invention are put forward in view of the above-described circumstances, and provide a novel method for use in a fixing device.

In one exemplary embodiment, the fixing device includes a heat roller, a fuser roller, and an endless, fuser belt. The heat roller has a surface thereof heated to an adjustable, heating temperature. The fuser roller is disposed parallel to the heat roller and has a surface thereof formed of elastic material deposited upon a cylindrical core of metal. The fuser belt is looped for rotation around the fuser roller and the heat roller. The novel method includes the steps of detection and adjustment. The detection step detects a first temperature at the cylindrical core of the fuser roller. The adjustment step adjusts the heating temperature according to the first temperature being detected.

Still other exemplary aspects of the present invention are put forward in view of the above-described circumstances, and provide an image forming apparatus incorporating a fixing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
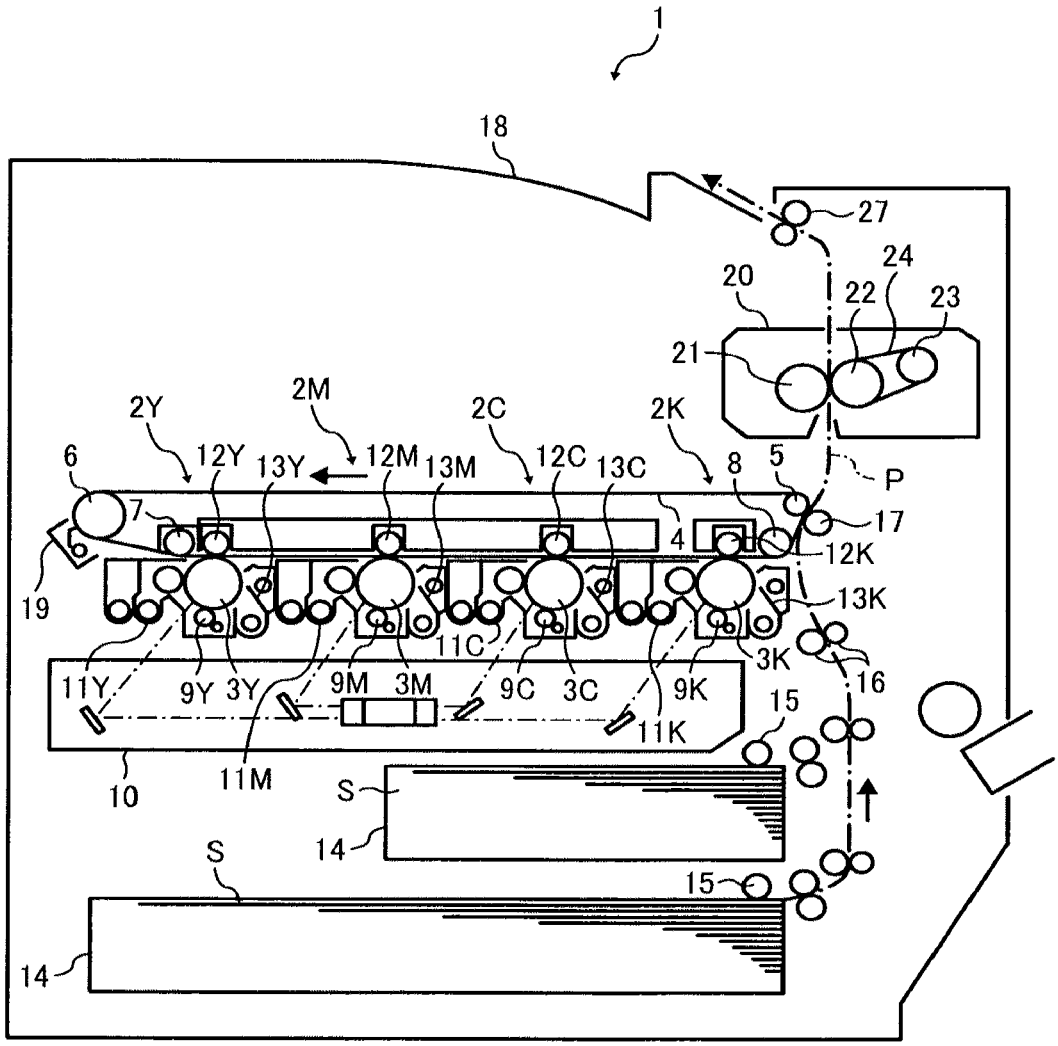
FIG. 1 schematically illustrates an image forming apparatus incorporating a fixing device according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to this patent specification As shown in FIG. 1, the image forming apparatus 1 includes an electrophotographic imaging unit consisting of four imaging stations 2Y, 2M, 2C, and 2K arranged in series substantially laterally along the length of an intermediate transfer belt 4, each forming an image with toner particles of a particular primary color, as designated by the suffixes "Y" for yellow, "M" for magenta, "C" for cyan, and "K" for black.

Each imaging station 2 includes a drum-shaped photoconductor 3 rotatable counterclockwise in the drawing, surrounded by various pieces of imaging equipment, such as a charging roller 9, a laser exposure device 10, a development device 11 accommodating toner of the associated primary color, an electrically biased, primary transfer roller 12, a cleaning device 13 for the photoconductive surface, etc., which work in cooperation to form a primary toner image on the photoconductor 3 for subsequent transfer to the intermediate transfer belt 4 at a primary transfer nip defined between the photoconductive drum 3 and the primary transfer roller 12.

The intermediate transfer belt 4 is trained around multiple support rollers 5, 6, 7, and 8 to rotate counterclockwise in the drawing, passing through the four primary transfer nips sequentially to carry thereon a multi-color toner image toward a secondary transfer nip defined between a secondary transfer roller 17 and the support roller 5, with a belt cleaner 19 cleaning the belt surface upstream of the primary transfer nips.

The fixing device 20 includes a fuser roller 22, a heat roller 23, an endless fuser belt 24 trained around the rollers 22 and 23, and a pressure roller 21 pressed against the fuser belt 24 to form a fixing nip therebetween. A detailed description of the fixing device 20 and its associated structure will be given later with reference to FIG. 2 and subsequent drawings.

Below and adjoining the electrophotographic imaging unit 2 and the fixing device 20 is a sheet conveyance mechanism including one or more input sheet trays 14 each accommodating a stock of recording media such as paper sheets S and equipped with a feed roller 15. The sheet conveyance mechanism also includes a pair of registration rollers 16, an output unit formed of a pair of output rollers 27, an output sheet tray 18, and other guide rollers or plates disposed between the input and output trays 14 and 18, which together define a sheet conveyance path P for conveying a recording sheet S from the input tray 14, between the registration rollers 16, then through the secondary transfer nip, then through the fixing device 20, and then between the output rollers 27 to the output tray 18.

During operation, the image forming apparatus 1 can perform printing in various print modes, including a monochrome print mode and a full-color print mode, as specified by a print job received from a user.

In full-color printing, each imaging station 2 rotates the photoconductor drum 3 clockwise in the drawing to forward its outer, photoconductive surface to a series of electrophotographic processes, including charging, exposure, development, transfer, and cleaning, in one rotation of the photoconductor drum 3.

First, the photoconductive surface is uniformly charged by the charging roller 9 and subsequently exposed to a modulated laser beam emitted from the writing unit 10. The laser exposure selectively dissipates the charge on the photoconductive surface to form an electrostatic latent image thereon according to image data representing a particular primary color. Then, the latent image enters the development device 11 which renders the incoming image visible using toner. The toner image thus obtained is forwarded to the primary transfer nip at which the incoming image is transferred to the intermediate transfer belt 4 with an electrical bias applied to the primary transfer roller 12.

As the multiple imaging stations 2 sequentially produce toner images of different colors at the four transfer nips along the belt travel path, the primary toner images are superimposed one atop another to form a single multicolor image on the moving surface of the intermediate transfer belt 4 for subsequent entry to the secondary transfer nip between the secondary transfer roller 17 and the belt support roller 5.

Meanwhile, the sheet conveyance mechanism picks up a recording sheet S from atop the sheet stack in the sheet tray 14 to introduce it between the pair of registration rollers 16 being rotated. Upon receiving the incoming sheet S, the registration rollers 16 stop rotation to hold the sheet S therebetween, and then advance it in sync with the movement of the intermediate transfer belt 4 to the secondary transfer nip at which the multicolor image is transferred from the belt 4 to the recording sheet S with an electrical bias applied to the secondary transfer roller.

After secondary transfer, the intermediate transfer belt 4 is cleaned of residual toner by the belt cleaner 14 whereas the recording sheet S is introduced into the fixing device 20 to fix the toner image in place under heat and pressure. Thereafter, the recording sheet S is output to the output tray 18 for stacking outside the apparatus body, as the rotating output rollers 27 advance the recording sheet S downstream from the fixing device 20 along the sheet conveyance path P.

Figure 2:
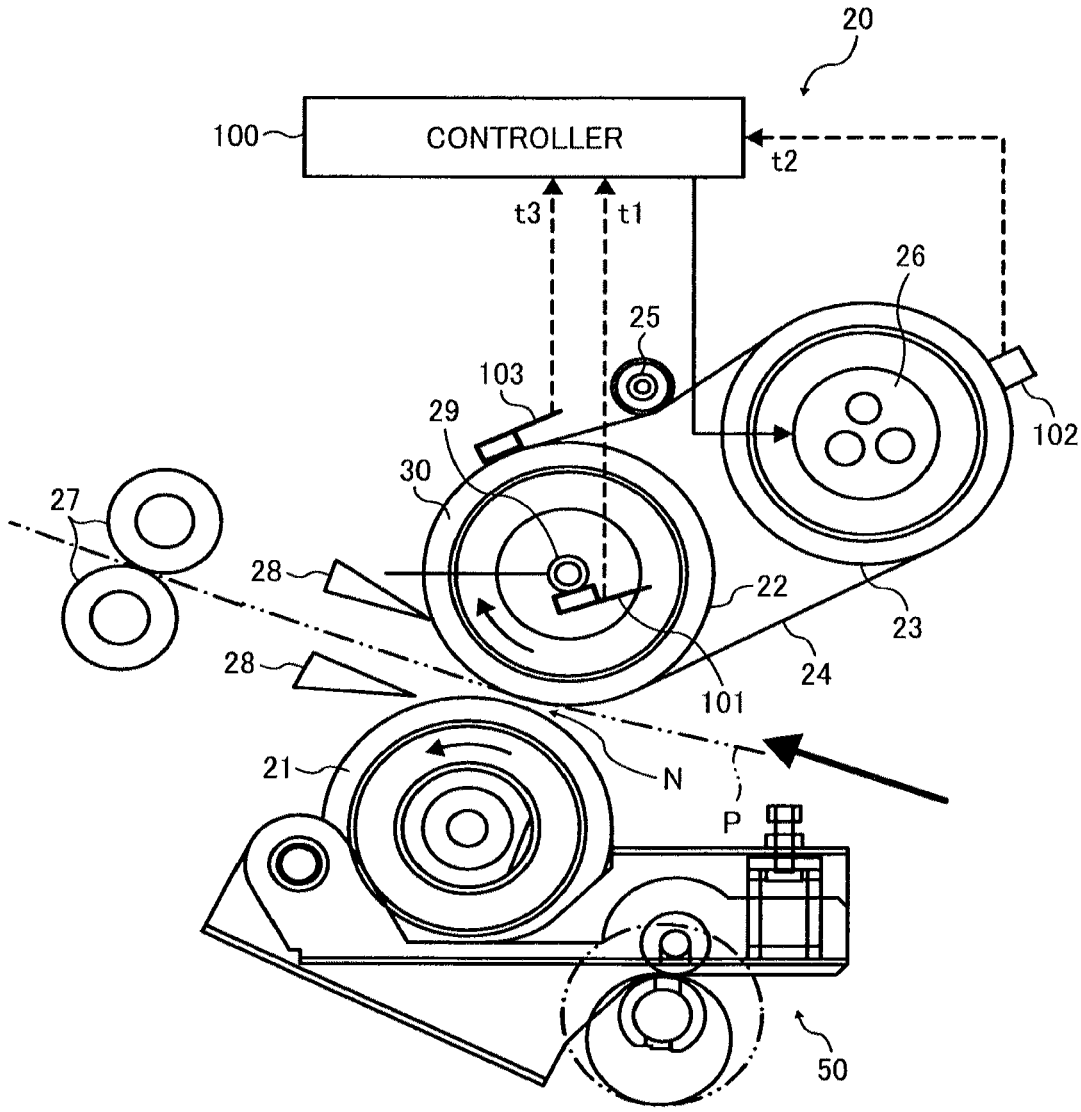
FIG. 2 is an end-on, axial cutaway view schematically illustrating the fixing device according to one or more embodiments of this patent specification.

FIG. 2 is an end-on, axial cutaway view schematically illustrating the fixing device 20 according to one or more embodiments of this patent specification.

As shown in FIG. 2, the fixing device 20 includes a fuser roller 22 having a circumference thereof formed of a thick elastic layer 30 deposited on a rigid, cylindrical core 29 of metal; a heat roller 23 having a circumference thereof heated by an internal heater 26; an endless, fuser belt 24 looped for rotation around the fuser roller 22 and the heat roller 23 disposed parallel to each other; and a pressure roller 21 disposed opposite the fuser roller 22 with the fuser belt 24 interposed between the pressure roller 21 and the fuser roller 22 to form a fixing nip N therebetween.

Also included in the fixing device 20 are a tension roller 25 elastically biased against the fuser belt 24; a pair of sheet strippers 28 held against the opposed fixing rollers 21 and 22, respectively; and an adjustable biasing mechanism 50 adjustably pressing the pressure roller 21 against the fuser roller 22 via the fuser belt 24.

Rotary components of the fixing device 20, such as the rollers 21, 22, and 23, recited above, all extend in a direction perpendicular to the sheet of paper on which the FIG. is drawn, each rotatably held on a frame or enclosure housing of the fixing device 20, with associated pieces of fixing equipment, such as rotary driver and heat source, fixed to the enclosure housing.

Specifically, the fuser belt 24 is entrained around the fuser roller 22 and the heat roller 23, with the tension roller 25 tightening the belt 24 to hold it in close contact with the circumferential surfaces of the rollers 22 and 23. The tension roller 25 is located substantially equidistant from the two belt-supporting rollers 22 and 23, loaded against the belt 24 with a spring or other suitable biasing mechanism. Although the present embodiment describes the tension roller 25 facing the outer circumference of the fuser belt 24, alternatively, instead, the tension roller 25 may be disposed on the inner circumference of the fuser belt 24. Through the fuser belt 24 thus made taut, the pressure roller 21 is pressed against the fuser roller 22 thereby forming the fixing nip N between their adjoining surfaces.

More specifically, in the present embodiment, the fuser belt 24 comprises a rotatable endless belt formed of a substrate of heat-resistant material or film such as polyimide (PI), upon which may be provided an outer, protective coating of a release agent such as tetra fluoro ethylene-perfluoro alkylvinyl ether copolymer or perfluoroalkoxy (PFA) to prevent offset or undesirable transfer of toner to the outer surface of the belt 24. For example, the fuser belt 24 may be an endless PI belt approximately 90 micrometers (μm) thick coated with a PFA protective layer deposited thereupon.

The fuser roller 22 comprises a rubber-covered, motor-driven rotatable cylindrical body, having the cylindrical core 29 formed of rigid material, such as iron, aluminum, or other suitable metal, and the outer elastic layer 30 formed of silicone rubber or the like. A rotary drive unit is provided comprising a motor connected to the fuser roller 22 via a reduction gear train, so as to drive the fuser roller 22 to rotate in coordination with other parts of the fixing assembly according to a control signal transmitted thereto.

The heat roller 23 comprises a hollow cylindrical body accommodating the internal heater 26 in its hollow interior. The heater 26 may be a halogen heater, an infrared heater, or any suitable electrical resistance heater.

The tension roller 25 comprises an elastically coated cylindrical body, consisting of a hollow cylindrical core of rigid material, such as aluminum or other suitable metal, coated with an outer layer of elastic material, such as heat-resistant felt or silicone rubber, deposited thereupon.

The pressure roller 21 comprises a rubber-covered, hollow cylindrical body, optionally provided with a dedicated internal heater accommodated in its hollow interior.

With continued reference to FIG. 2, the fixing device 20 is shown including first through third thermometers or thermistors 101 through 103 disposed at different portions of the fuser assembly, as well as a controller 100 operatively connected with the heater 26 as well as with each of the multiple thermistors 101 through 103.

Specifically, the controller 100 in the present embodiment is incorporated in a control system of the image forming apparatus 1, including a central processing unit (CPU) that controls overall operation of the apparatus 1, as well as its associated memory devices, such as a read-only memory (ROM) storing program codes for execution by the CPU and other types of fixed data, a random-access memory (RAM) for temporarily storing data, and a rewritable, non-volatile random-access memory (NVRAM) for storing data during power-off. Such a control system may also include a rotary drive for driving a motor-driven rotary member included in the apparatus 1, such as a photoconductive drum, a fixing roller, or the like.

The first thermistor 101 is disposed adjacent to the fuser roller 22 to detect a first temperature t1 at the cylindrical core 29 of the fuser roller 22 for communication to the controller 100. The second thermistor 102 is disposed on the fuser belt 24 where the fuser belt 24 contacts the heat roller 23 to detect a second temperature t2 at the circumference of the heat roller 23 via the fuser belt 24 for communication to the controller 100. The third thermistor 103 is disposed on the fuser belt 24 where the fuser belt 24 contacts the fuser roller 22 to detect a third temperature t3 at the circumference of the fuser roller 22 via the fuser belt 24 for communication to the controller 100.

Based on the temperatures t1 through t3 thus detected by the first through third thermistors 101 through 103, the controller 100 controls the heater 26 to maintain an appropriate operating temperature with which the fixing device 20 processes a toner image through the fixing nip N. Such power supply control may be based on on-off control of power supply to the heater 26, as well as other suitable control methods depending on the specific application.

During operation, the motor-driven fuser roller 22 rotates, together with the fuser belt 24, in a given rotational direction (i.e., clockwise in the drawing) as the rotary drive unit imparts torque or rotational force to the roller core 29 with a constant rotational speed via the gear train, which in turn rotates the pressure roller 21 in the opposite direction (i.e., counterclockwise in the drawing).

The fuser belt 24 during rotation is kept in proper tension with the tension roller 15 pressing against the belt 24 from outside of the belt loop, while having its circumference heated with the heat roller 23 to a given processing temperature sufficient for fusing toner through the fixing nip N.

In this state, a recording sheet S bearing an unfixed, powder toner image T enters the fixing device 20 along a sheet guide defining the sheet conveyance path P. As the rotary fixing members rotate together, the recording sheet S is passed through the fixing nip N to fix the toner image in place, wherein heat from the fuser belt 24 causes toner particles to fuse and melt, while pressure from the pressure roller 21 causes the molten toner to settle onto the sheet surface.

At the exit of the fixing nip N, the recording sheet S has its leading edge stripped from the rotary members by the associated sheet strippers 28, which then proceeds to the output roller pair 27 forwarding the incoming sheet S, and finally enters the output tray 18 from the sheet conveyance path P.

In such a configuration, a cumulative amount of heat and pressure applied to the recording sheet S conveyed at a constant speed through the fixing nip N is influenced by changes in the operating temperature which cause the elastic material of the fuser roller 22 to thermally expand and contract.

Specifically, raising the operating temperature causes thermal expansion of the fuser roller 22 to increase the length and depth to which the fuser roller 22 engages the pressure roller 21, resulting in an increased amount of heat and pressure applied to the recording sheet S during passage through the fixing nip N. Contrarily, lowering the operating temperature causes thermal contraction of the fuser roller 22 to decrease the length and depth to which the fuser roller 22 engages the pressure roller 21, resulting in a decreased amount of heat and pressure applied to the recording sheet S during passage through the fixing nip N.

Since good melting and fusion of toner to the recording sheet S depends on consistent application of a sufficient amount of heat and pressure through the fixing nip, variations in the fixing nip N, in particular, a reduction in heat and pressure applied to the recording sheet S, adversely affect performance of a fixing device. In general, an excessively low operating temperature causes significant defects in a resulting image due to insufficient heating through the fixing nip, which tends to occur where printing is performed under non-steady state conditions, e.g., immediately upon power-on, using a fixed operating temperature originally designed for steady state conditions. On the other hand, fixing performance improves with increasing operating temperature causing thermal expansion of the fuser roller, insofar as the operating temperature is maintained within a normal, appropriate range.

Figure 3:
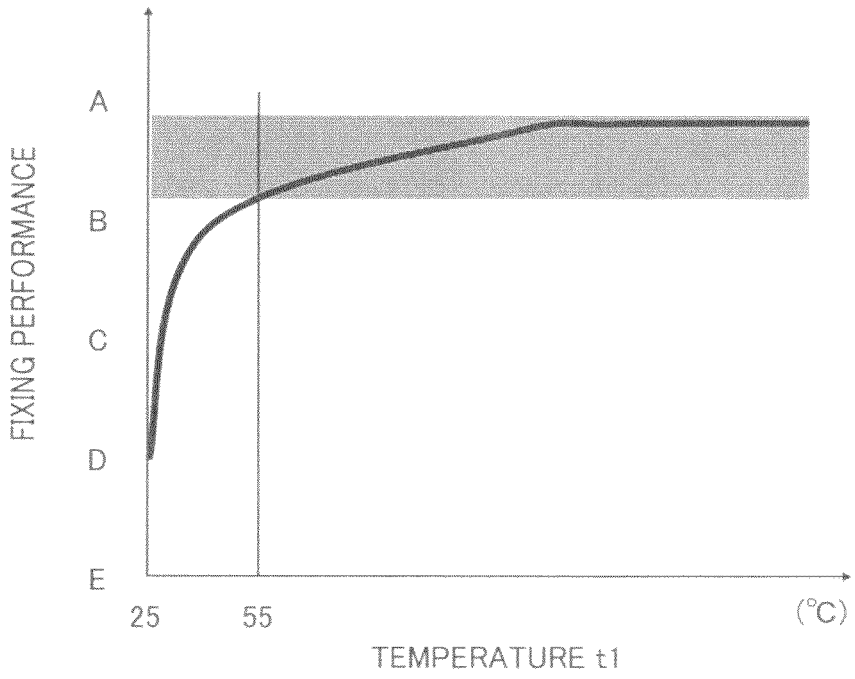
FIG. 3 is a graph showing quality of fixing performance plotted against a first temperature detected at a metal core of a fuser roller driven with a fixed rotational speed.

FIG. 3 is a graph showing quality of fixing performance with which a toner image is processed through the fixing nip N, plotted against the first temperature t1, in degrees Celsius (° C.), detected at the metal core 29 of the fuser roller 22 driven with a fixed rotational speed.

In this and subsequent examples, quality of fixing performance is classified into five categories: A="Excellent", B="Good", C="Average", D="Fair", and E="Poor". Of the five categories presented herein, the preceding two indicate a desired, acceptable level for practical application to provide reliable fixing performance. Fixing performance may be dictated by appearance and other properties of a resulting image, as well as immunity against failures in conveyance through the fixing nip, such as a recording sheet rubbing against a sheet stripper or other surrounding structure to cause smudges on a resulting image, or wrapping around the fixing member to cause a jam in the fixing nip. Acceptable fixing performance may be defined otherwise depending on specific application and requirements.

As shown in FIG. 3, where the roller temperature t1 remains low, the fixing performance is relatively low, for example, remaining at the category D at a roller temperature t1 of approximately 25° C. As the roller temperature t1 rises, causing the fuser roller 22 to thermally expand, the fixing performance improves and reaches the category B at a roller temperature of approximately 55° C. or higher. Thus, an acceptable level of fixing performance (indicated by shading in the graph) is obtained where the roller temperature t1 equals or exceeds a lower limit of approximately 55° C.

According to this patent specification, the fixing device 20 adjusts a heating temperature to which the heat roller 23 is heated by the heater 26 according to an operating temperature detected therein during operation, so as to maintain an acceptable fixing performance regardless of an amount of heat accumulated in the fuser roller 22, which can deviate or suddenly change from a designed level depending on environmental and operational conditions, such as operation immediately after power-on in a low ambient temperature (upon which the fuser roller is almost devoid of accumulated heat), or after sequential entry of multiple recording sheets through the fixing nip (during which the fuser roller absorbs substantial heat from the heated fuser belt entrained therearound).

Specifically, in a first embodiment, the controller 100 adjusts the heating temperature of the heat roller 23 according to the first temperature t1 detected by the first thermistor 101, so as to maintain an acceptable fixing performance regardless of the diameter of the fuser roller 22 varying with the operating temperature or the amount of heat accumulated therein. Such heating temperature adjustment may be performed continuously during execution of a specific print job (i.e., from entry of a recording sheet into the sheet conveyance path to completion of image formation on the recording sheet entered) in the image forming apparatus 1.

More specifically, the controller 100 corrects an originally designed, reference heating temperature Tref of the heat roller 23 with a variable amount of correction α dependent on the first temperature t1 detected. The correction variable α for heating temperature adjustment may be defined as a variable increment by which the reference temperature Tref is incremented to obtain an adjusted heating temperature T, as follows:

$$T = Tref + \alpha$$

In the present embodiment, the controller 100 includes a predefined table or list of correction variables α for heating temperature adjustment, stored in an appropriate memory such as ROM or the like, which contains one or more thresholds or ranges for the first temperature t1 each associated with a specific correction variable α. An example of such correction table is provided as follows.

TABLE 1

| TEMPERATURE DETECTED | CORRECTION VARIABLE α |
|---|---|
| t1 < 55° C. | 5° C. |
| t1 ≥ 55° C. | 0 |

According to the correction table TABLE 1, the heating temperature T is incremented from the reference value Tref by an increment of 5° C. where the first temperature t1 detected falls below a threshold temperature of 55° C., and is maintained at the original temperature Tref where the first temperature t1 detected equals or exceeds the threshold temperature.

Although the correction table above contains only a single threshold for the first temperature t1, heating temperature adjustment by the controller 100 may be carried out with multiple temperature thresholds or ranges for the first temperature t1, each of which is associated with a specific correction variable and contained in a predefined correction table as described herein. Also, although the present embodiment depicts heating temperature adjustment performed continuously during execution of a specific print job, temperature sensing as well as heating temperature adjustment based thereupon may be carried out intermittently or at discrete intervals depending on specific configuration of the image forming apparatus.

Figure 4:
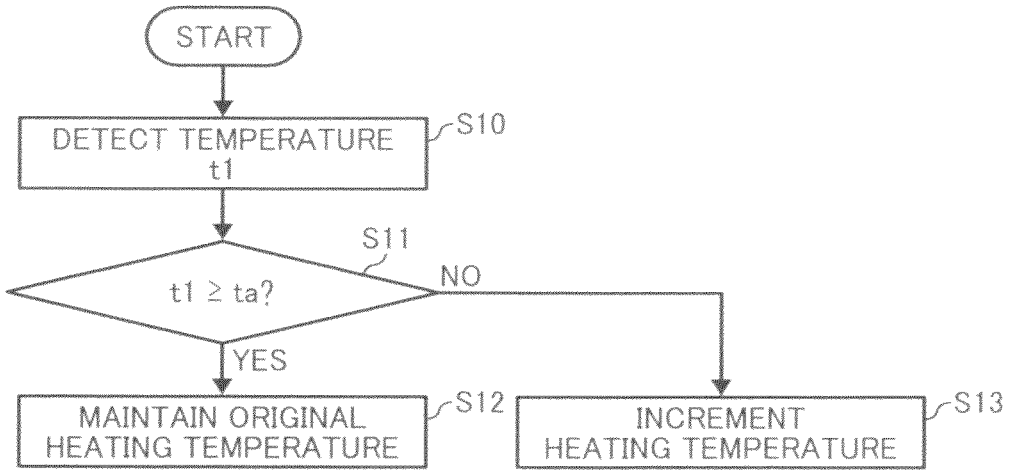
FIG. 4 is a flowchart illustrating an example of heating temperature adjustment according to a first embodiment of this patent specification.

FIG. 4 is a flowchart illustrating an example of heating temperature adjustment performed based on the correction table represented in TABLE 1.

As shown in FIG. 4, initially, the first thermistor 101 detects a first temperature t1 at the metal core 29 of the fuser roller 22 (step S10), followed by the controller 100 determining whether the detected temperature t1 exceeds a threshold temperature to of, for example, 55° C. (step S11).

Where the detected temperature t1 equals or exceeds the threshold temperature ta, indicating that operating temperature is sufficiently high to allow for an acceptable fixing performance ("YES" at step S11), the controller 100 sets the correction increment α to 0 so as to maintain the heating temperature T at the original, reference value Tref (step S12).

Where the detected temperature t1 falls below the threshold temperature ta, indicating that the operating temperature is too low to provide an acceptable fixing performance ("NO" at step S11), the controller 100 sets the correction increment α to a given positive value of, for example, 5° C., so as to raise the heating temperature T from the original, reference value Tref (step S13).

Incrementing the heating temperature T where the first temperature t1 detected at the metal core 29 of the fuser roller 22 falls below the threshold temperature ta effectively compensates for a reduction in heat and pressure applied to a recording sheet S passing through the fixing nip N, caused by thermal contraction of the fuser roller 22 at the low operating temperature, which enables the fixing device 20 to process the recording sheet S with a desired, acceptable performance quality.

Although in the embodiment above, the control flow includes only a single determination step in which the detected temperature is compared with a threshold temperature to determine a correction variable, heating temperature adjustment according to this patent specification may be accomplished with multiple determination steps for more specifically determining the operating temperature in which case the correction table includes multiple temperature thresholds with multiple correction variables associated therewith.

Hence, the fixing device 20 according to the first embodiment of this patent specification maintains reliable performance regardless of an amount of heat accumulated in the fuser roller 22 through relatively simple heating temperature adjustment, in which the controller 100 adjusts the heating temperature T of the heat roller 23 depending on the temperature t1 detected at the cylindrical core 29 of the fuser roller 22, indicative of thermal conditions or variations in diameter of the fuser roller 22, so that the fixing device can process a toner image with good imaging quality and high immunity against failures due to insufficient heating of the fuser roller 22 (e.g., immediately after power-on), even where the fuser roller is configured as a thick rubber-coated, metal-cored cylindrical body with no dedicated heater provided therein.

In further embodiments, the fixing device 20 may perform heating temperature adjustment based not only on the first temperature t1 but also on the second and third temperatures t2 and t3, or on any combination of such detected temperatures. Compared to control relying only on the first temperature t1, which tends to fluctuate due to the metal core heating and cooling rapidly during operation, using a combination of multiple detected temperatures allows the controller 100 to more accurately determine the operational conditions, so as to more accurately correct the heating temperature according to thermal expansion or contraction experienced by the fuser roller 22, thereby obtaining a desired fixing performance regardless of an amount of heat accumulated in the fuser roller 22. Several such embodiments are described below with reference to FIG. 5 and subsequent drawings.

Figure 5:
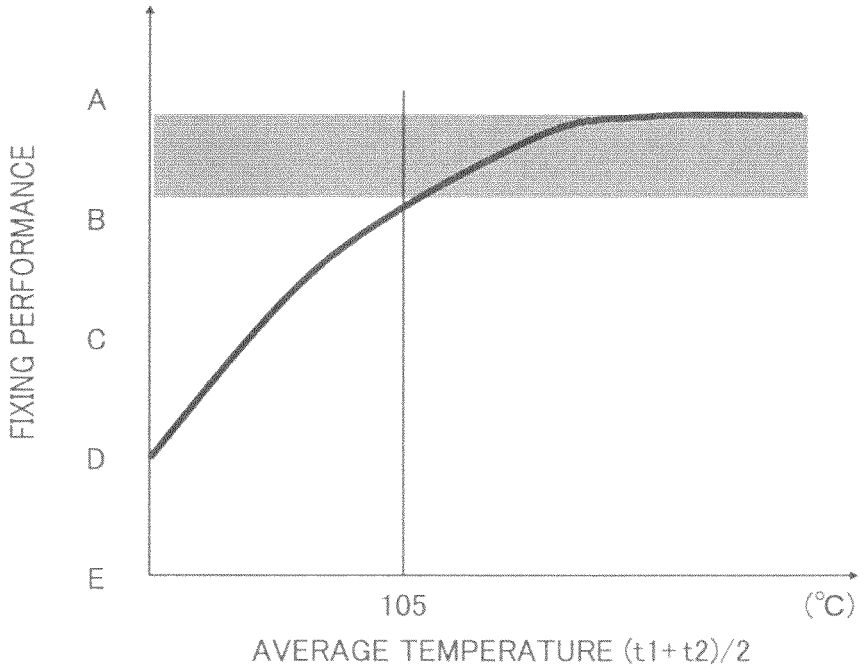
FIG. 5 is a graph showing quality of fixing performance plotted against an average of a first and second temperatures, the former detected at a metal core of a fuser roller driven with a fixed rotational speed, and the latter on a fuser belt along the circumference of a heat roller.

FIG. 5 is a graph showing quality of fixing performance plotted against an average of the first and second temperatures t1 and t2, in degrees Celsius (° C.), the former detected at the metal core 29 of the fuser roller 22 driven with a fixed rotational speed, and the latter on the fuser belt 24 along the circumference of the heat roller 23.

As shown in FIG. 5, where the average temperature (t1+t2)/2 remains low, the fixing performance is relatively low and practically unacceptable. As the average temperature (t1+t2)/2 rises, causing the fuser roller 22 to thermally expand, the fixing performance improves and reaches the category B at a roller temperature of approximately 105° C. or higher. Thus, an acceptable level of fixing performance (indicated by shading in the graph) is obtained where the average temperature (t1+t2)/2 equals or exceeds a lower limit of approximately 105° C.

In a second embodiment, the controller 100 adjusts the heating temperature of the heat roller 23 according to the average of the first and second temperatures t1 and t2 detected by the first and second thermistors 101 and 102, respectively, so as to maintain an acceptable fixing performance regardless of the diameter of the fuser roller 22 varying with the operating temperature or the amount of heat accumulated therein. Such heating temperature adjustment may be performed continuously during execution of a specific print job in the image forming apparatus 1.

As is the case with the first embodiment depicted earlier, such heating temperature adjustment may be performed, for example, by correcting an originally designed, reference heating temperature Tref of the heat roller 23 with a variable amount of correction α dependent on the average of the first and second temperatures t1 and t2 detected.

In the present embodiment, the controller 100 includes a predefined table or list of correction variables α for heating temperature adjustment, stored in an appropriate memory such as ROM or the like, which contains one or more thresholds or ranges for the average temperature (t1+t2)/2 each associated with a specific correction variable α. An example of such correction table is provided as follows.

TABLE 2

| TEMPERATURE DETECTED | CORRECTION VARIABLE α |
|---|---|
| (t1 + t2)/2 < 105° C. | 5° C. |
| (t1 + t2)/2 ≥ 105° C. | 0 |

According to the correction table TABLE 2, the heating temperature T is incremented from the reference value Tref by an increment of 5° C. where the average temperature (t1+t2)/2 detected falls below a threshold temperature of 105° C., and is maintained at the original temperature Tref where the average temperature (t1+t2)/2 detected equals or exceeds the threshold temperature.

As is the case with the foregoing embodiment, although the correction table above contains only a single threshold for the average temperature (t1+t2)/2, heating temperature adjustment by the controller 100 may be carried out with multiple temperature thresholds or ranges for the average temperature (t1+t2)/2, each of which is associated with a specific correction variable and contained in a predefined correction table as described herein.

Figure 6:
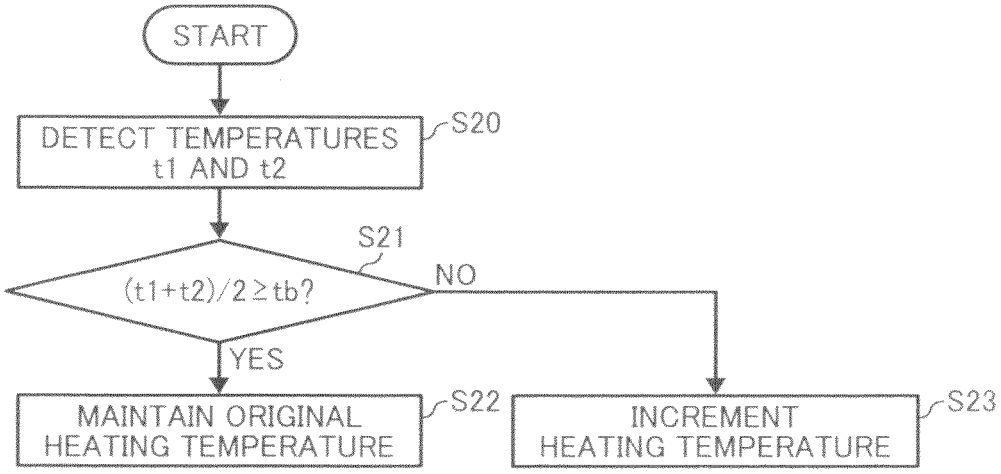
FIG. 6 is a flowchart illustrating an example of heating temperature adjustment according to a second embodiment of this patent specification.

FIG. 6 is a flowchart illustrating an example of heating temperature adjustment performed based on the correction table represented in TABLE 2.

As shown in FIG. 6, initially, the first and second thermistors 101 and 102 detect first and second temperatures t1 and t2, respectively, the former at the metal core 29 of the fuser roller 22, and the latter on the fuser belt 24 along the circumference of the heat roller 23 (step S20). Then, the controller 100 determines whether the average of the detected temperatures (t1+t2)/2 exceeds a threshold temperature tb of, for example, 105° C. (step S21).

Where the detected average temperature (t1+t2)/2 equals or exceeds the threshold temperature tb, indicating that operating temperature is sufficiently high to allow for an acceptable fixing performance ("YES" at step S21), the controller 100 sets the correction increment α to 0 so as to maintain the heating temperature T at the original, reference value Tref (step S22).

Where the detected average temperature (t1+t2)/2 falls below the threshold temperature tb, indicating that the operating temperature is too low to provide an acceptable fixing performance ("NO" at step S21), the controller 100 sets the correction increment α to a given positive value of, for example, 5° C., so as to raise the heating temperature T from the original, reference value Tref (step S23).

Incrementing the heating temperature T where the average (t1+t2)/2 of temperatures detected at the metal core 29 of the fuser roller 22 and on the fuser belt 24 along the circumference of the heat roller 23, respectively, falls below the threshold temperature tb effectively compensates for a reduction in heat and pressure applied to a recording sheet S passing through the fixing nip N, caused by thermal contraction of the fuser roller 22 at the low operating temperature, which enables the fixing device 20 to process the recording sheet S with a desired, acceptable performance quality.

Hence, the fixing device 20 according to the second embodiment of this patent specification maintains reliable performance regardless of an amount of heat accumulated in the fuser roller 22 through relatively simple heating temperature adjustment, in which the controller 100 adjusts the heating temperature T of the heat roller 23 depending on the temperature t1 detected at the cylindrical core 29 of the fuser roller 22 as well as the temperature t2 detected on the fuser belt 24 along the circumference of the heat roller 23, both indicative of thermal conditions or variations in diameter of the fuser roller 22, so that the fixing device can process a toner image with good imaging quality and high immunity against failures due to insufficient heating of the fuser roller 22 (e.g., immediately after power-on), even where the fuser roller is configured as a thick rubber-coated, metal-cored cylindrical body with no dedicated heater provided therein.

Compared to the foregoing embodiment, such heating temperature adjustment can more properly optimize the fixing performance according to accumulated heat causing dimensional variations of the thermally expansive, elastic roller 22, wherein the temperature t2 detected at the circumference of the heat roller 23 is substantially consistent with that detected at the circumference of the fuser roller 22, so that the average of the first and second temperatures t1 and t2 indicates an amount of heat accumulated within the elastic layer of the fuser roller 22 more precisely or stably than does the first temperature t1 alone.

Figure 7:
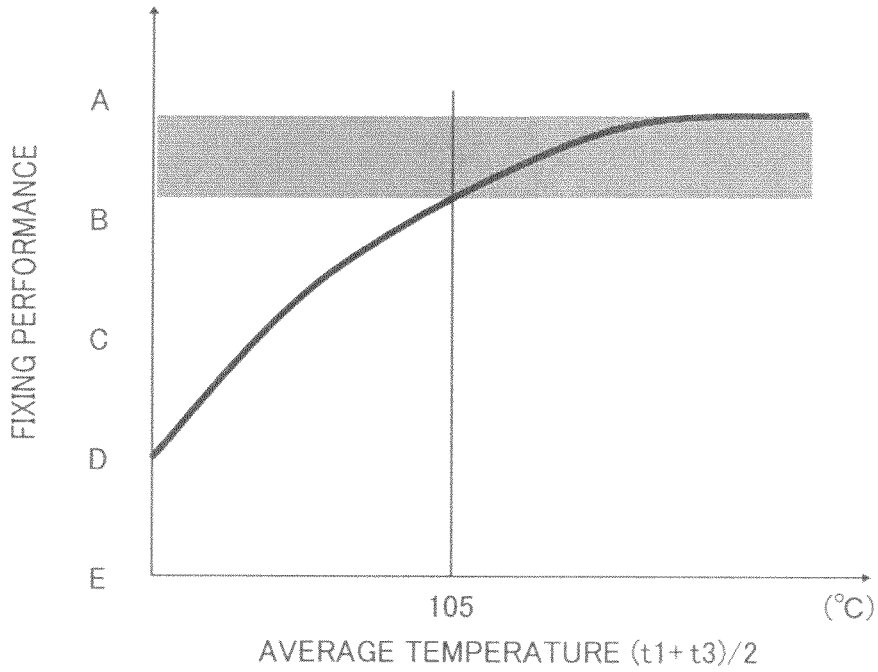
FIG. 7 is a graph showing quality of fixing performance plotted against an average of a first and third temperatures, the former detected at a metal core of a fuser roller driven with a fixed rotational speed, and the latter on a fuser belt along the circumference of the fuser roller.

FIG. 7 is a graph showing quality of fixing performance plotted against an average of the first and third temperatures a and t3, in degrees Celsius (° C.), the former detected at the metal core 29 of the fuser roller 22 driven with a fixed rotational speed, and the latter on the fuser belt 24 along the circumference of the fuser roller 22.

As shown in FIG. 7, where the average temperature (t1+t3)/2 remains low, the fixing performance is relatively low and practically unacceptable. As the average temperature (t1+t3)/2 rises, causing the fuser roller 22 to thermally expand, the fixing performance improves and reaches the category B at a roller temperature of approximately 105° C. or higher. Thus, an acceptable level of fixing performance (indicated by shading in the graph) is obtained where the average temperature (t1+t3)/2 equals or exceeds a lower limit of approximately 105° C.

In a third embodiment, the controller 100 adjusts the heating temperature of the heat roller 23 according to the average of the first and third temperatures t1 and t3 detected by the first and third thermistors 101 and 103, respectively, so as to maintain an acceptable fixing performance regardless of the diameter of the fuser roller 22 varying with the operating temperature or the amount of heat accumulated therein. Such heating temperature adjustment may be performed continuously during execution of a specific print job in the image forming apparatus 1.

As is the case with the first embodiment depicted earlier, such heating temperature adjustment may be performed, for example, by correcting an originally designed, reference heating temperature Tref of the heat roller 23 with a variable amount of correction α dependent on the average of the first and third temperatures t1 and t3 detected.

In the present embodiment, the controller 100 includes a predefined table or list of correction variables α for heating temperature adjustment, stored in an appropriate memory such as ROM or the like, which contains one or more thresholds or ranges for the average temperature (t1+t3)/2 each associated with a specific correction variable α. An example of such correction table is provided as follows.

TABLE 3

| TEMPERATURE DETECTED | CORRECTION VARIABLE α |
|---|---|
| (t1 + t3)/2 < 105° C. | 5° C. |
| (t1 + t3)/2 ≥ 105° C. | 0 |

According to the correction table TABLE 3, the heating temperature T is incremented from the reference value Tref by an increment of 5° C. where the average temperature (t1+t3)/2 detected falls below a threshold temperature of 105° C., and is maintained at the original temperature Tref where the average temperature (t1+t3)/2 detected equals or exceeds the threshold temperature.

As is the case with the foregoing embodiment, although the correction table above contains only a single threshold for the average temperature (t1+t3)/2, heating temperature adjustment by the controller 100 may be carried out with multiple temperature thresholds or ranges for the average temperature (t1+t3)/2, each of which is associated with a specific correction variable and contained in a predefined correction table as described herein.

Figure 8:
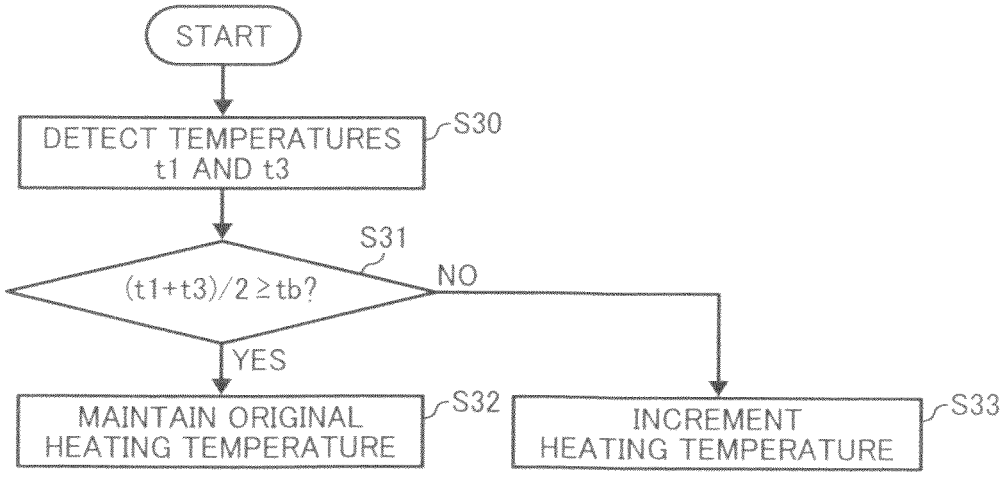
FIG. 8 is a flowchart illustrating an example of heating temperature adjustment according to a third embodiment of this patent specification.

FIG. 8 is a flowchart illustrating an example of heating temperature adjustment performed based on the correction table represented in TABLE 3.

As shown in FIG. 8, initially, the first and third thermistors 101 and 103 detect first and third temperatures a and t3, respectively, the former at the metal core 29 of the fuser roller 22, and the latter on the fuser belt 24 along the circumference of the fuser roller 22 (step S30). Then, the controller 100 determines whether the average of the detected temperatures (t1+t3)/2 exceeds a threshold temperature tb of, for example, 105° C. (step S31).

Where the detected average temperature (t1+t3)/2 equals or exceeds the threshold temperature tb, indicating that operating temperature is sufficiently high to allow for an acceptable fixing performance ("YES" at step S31), the controller 100 sets the correction increment α to 0 so as to maintain the heating temperature T at the original, reference value Tref (step S32).

Where the detected average temperature (t1+t3)/2 falls below the threshold temperature tb, indicating that the operating temperature is too low to provide an acceptable fixing performance ("NO" at step S31), the controller 100 sets the correction increment α to a given positive value of, for example, 5° C., so as to raise the heating temperature T from the original, reference value Tref (step S33).

Incrementing the heating temperature T where the average (t1+t3)/2 of temperatures detected at the metal core 29 of the fuser roller 22 and on the fuser belt 24 along the circumference of the fuser roller 22, respectively, falls below the threshold temperature tb effectively compensates for a reduction in heat and pressure applied to a recording sheet S passing through the fixing nip N, caused by thermal contraction of the fuser roller 22 at the low operating temperature, which enables the fixing device 20 to process the recording sheet S with a desired, acceptable performance quality.

Hence, the fixing device 20 according to the third embodiment of this patent specification maintains reliable performance regardless of an amount of heat accumulated in the fuser roller 22 through relatively simple heating temperature adjustment, in which the controller 100 adjusts the heating temperature T of the heat roller 23 depending on the temperature t1 detected at the cylindrical core 29 of the fuser roller 22 as well as the temperature t3 detected on the fuser belt 24 along the circumference of the fuser roller 22, both indicative of thermal conditions or variations in diameter of the fuser roller 22, so that the fixing device can process a toner image with good imaging quality and high immunity against failures due to insufficient heating of the fuser roller 22 (e.g., immediately after power-on), even where the fuser roller is configured as a thick rubber-coated, metal-cored cylindrical body with no dedicated heater provided therein.

Compared to the foregoing embodiment, such heating temperature adjustment can more properly optimize the fixing performance according to accumulated heat causing dimensional variations of the thermally expansive, elastic roller 22, wherein the temperature t3 is detected directly at the circumference of the fuser roller 22, so that the average of the first and second temperatures t1 and t2 indicates an amount of heat accumulated within the elastic layer of the fuser roller 22 more precisely or stably than does the first temperature t 1 alone. This is particularly true upon start-up after prolonged standby during which the fuser roller 22 stops rotation while discharging heat without additional supply of heat from the heat roller 23, causing a sudden reduction in temperature at the circumference of the fuser roller 22.

Although in several embodiments depicted above, the controller 100 raises the heating temperature T from the original, reference value Tref where the detected temperature equals or exceeds a relatively low threshold temperature, indicating a relatively low amount of accumulated heat causing a thermal contraction of the fuser roller 22, such heating temperature adjustment may also be performed by lowering the heating temperature T from the original, reference value Tref where the detected temperature equals or exceeds a relatively high threshold temperature, indicating a relatively high amount of accumulated heat causing a thermal expansion of the fuser roller 22.

As described above with reference to FIG. 3, the fixing performance improves with the rising roller temperature t1, so as to reach an acceptable level where the roller temperature t1 equals or exceeds a lower limit of approximately 55° C. A further rise in the roller temperature t1, for example to approximately 95° C., however, would degrade the fixing performance, in which an excessive amount of heat applied to a recording sheet causes excessive gloss or other artifacts in a resulting image processed through the fixing nip. Such excessive heat application and concomitant performance degradation would occur where the fixing device is operated with a fixed, original heating temperature although a substantial amount of heat is accumulated in the metal core of the fuser roller, for example, upon sequential entry of multiple recording sheets through the fixing nip, or upon completion of printing on a special type of recording medium, such as thick paper, which necessitated a relatively high operating temperature higher than that used for a normal printing operation.

In a fourth embodiment, the controller 100 adjusts the heating temperature of the heat roller 23 by correcting an originally designed, reference heating temperature Tref with a variable amount of correction α dependent on the first temperature t1 as well as an average of the first and third temperatures (t1+t3)/2. Unlike the foregoing embodiments, the controller 100 lowers, instead of raises, the heating temperature T from the reference temperature Tref where the detected temperature equals or exceeds a given threshold temperature.

In the present embodiment, the controller 100 includes a predefined table or list of correction variables α for heating temperature adjustment, stored in an appropriate memory such as ROM or the like, which contains one or more thresholds or ranges for the first temperature t1 as well as the average of the first and third temperatures (t1+t3)/2 each associated with a specific correction variable α. An example of such correction table is provided as follows.

TABLE 4

| TEMPERATURE DETECTED | CORRECTION VARIABLE α |
|---|---|
| t1 < 95° C. | 0 |
| t1 ≥ 95° C. | −5° C. |
| (t1 + t3)/2 < 105° C. | 5° C. |
| (t1 + t3)/2 ≥ 105° C. | 0 |

According to the correction table TABLE 4, the heating temperature T is decremented from the reference value Tref by a decrement of 5° C. where the first temperature t1 equals or exceeds a first threshold temperature of 95° C., and is incremented from the reference value Tref by an increment of 5° C. where the average temperature (t1+t3)/2 falls below a second threshold temperature of 105° C. The heating temperature T is maintained at the original temperature Tref where the first temperature t1 detected falls below the first threshold temperature, or where the average temperature (t1+t3)/2 equals or exceeds the second threshold temperature.

Although the correction table above contains only a single threshold for each of the first temperature t1 and the average temperature (t1+t3)/2, heating temperature adjustment by the controller 100 may be carried out with multiple temperature thresholds or ranges for each of the first temperature t1 and the average temperature (t1+t3)/2, each of which is associated with a specific correction variable and contained in a predefined correction table as described herein.

Figure 9:
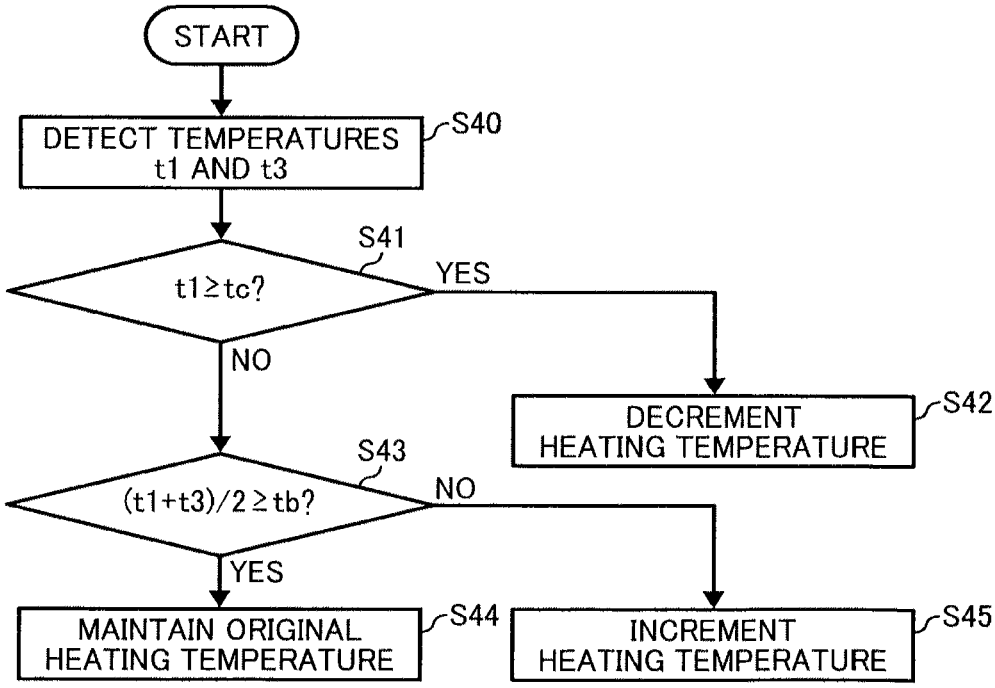
FIG. 9 is a flowchart illustrating an example of heating temperature adjustment according to a fourth embodiment of this patent specification.

FIG. 9 is a flowchart illustrating an example of heating temperature adjustment performed based on the correction table represented in TABLE 4.

As shown in FIG. 9, initially, the first and third thermistors T1 and T3 detect first and third temperatures t1 and t3, respectively, the former at the metal core 29 of the fuser roller 22, and the latter on the fuser belt 24 along the circumference of the fuser roller 22 (step S40). Then, the controller 100 determines whether the detected temperature t1 exceeds a first threshold temperature tc of, for example, 95° C. (step S41).

Where the detected temperature t1 equals or exceeds the threshold temperature tc, indicating that operating temperature is excessively high and detrimental to fixing performance ("YES" at step S41), the controller 100 sets the correction vαriable a to a given negative value of, for example, −5° C., so as to lower the heating temperature T from the original, reference value Tref (step S42).

Where the detected temperature t1 falls below the threshold temperature tc ("NO" at step S41), the controller 100 then determines whether the average of the detected temperatures (t1+t3)/2 exceeds a second threshold temperature tb of, for example, 105° C. (step S43).

Where the detected average temperature (t1+t3)/2 equals or exceeds the threshold temperature tb, indicating that the operating temperature is sufficiently high to allow for an acceptable fixing performance ("YES" at step S43), the controller 100 sets the correction increment α to 0 so as to maintain the heating temperature T at the original, reference value Tref (step S44).

Where the detected average temperature (t1+t3)/2 falls below the threshold temperature tb, indicating that the operating temperature is too low to provide an acceptable fixing performance ("NO" at step S43), the controller 100 sets the correction increment α to a given positive value of, for example, 5° C., so as to raise the heating temperature T from the original, reference value Tref (step S45).

Decrementing and incrementing the heating temperature T where the first temperature t1 exceeds the threshold temperature tc, and where the average (t1+t3)/2 of the first and third temperatures exceeds the threshold temperature tb, respectively, effectively compensates for variations in heat and pressure applied to a recording sheet S passing through the fixing nip N, caused by thermal expansion and contraction of the fuser roller 22 at the varying operating temperature, which enables the fixing device 20 to process the recording sheet S with a desired, acceptable performance quality.

Although the embodiment depicted in FIG. 9 controls heating temperature based on the combination of first and third temperatures t1 and t3, alternatively, instead, it is possible to determine whether to maintain the original heating temperature based on the combination of first and second temperatures t1 and t2. Moreover, although the present embodiment uses the first temperature t1 to determine whether to lower the heating temperature, alternatively, instead, it is possible base such determination upon either the average of the first and third temperatures (t1+t3)/2 or the average of the first and second temperatures (t1+t2)/2 with a threshold temperature appropriately scaled.

Hence, the fixing device 20 according to the fourth embodiment of this patent specification maintains reliable performance regardless of an amount of heat accumulated in the fuser roller 22 through relatively simple heating temperature adjustment, in which the controller 100 adjusts the heating temperature T of the heat roller 23 depending on the temperature t1 detected at the cylindrical core 29 of the fuser roller 22 as well as the temperature t3 detected on the fuser belt 24 along the circumference of the fuser roller 22, both indicative of thermal conditions or variations in diameter of the fuser roller 22, so that the fixing device can process a toner image with good imaging quality and high immunity against failures due to insufficient heating of the fuser roller 22 (e.g., immediately after power-on), even where the fuser roller is configured as a thick rubber-coated, metal-cored cylindrical body with no dedicated heater provided therein.

Compared to the foregoing embodiments, such heating temperature adjustment can more reliably maintain an appropriate fixing performance, wherein the controller 100 not only raises the heating temperature T upon detecting a relatively low operating temperature, indicating a relatively low amount of heat accumulated in the fuser roller 22, but also lowers the heating temperature T upon detecting a relatively high operating temperature, indicating a relatively high amount of heat accumulated in the fuser roller 22.

Although in several embodiments depicted above, heating temperature adjustment is performed based on the operating temperature detected continuously during execution of a print job, in further embodiments, it is possible that the controller 100 gradually resets or restores the corrected heating temperature T of the heat roller 23 to the original, reference temperature Tref, as an increased number of recording sheets S are successively processed through the fixing nip N.

Specifically, for example, the controller 100 may count a number of recording sheets S processed through the fixing nip N since activation, so as to restore the correction variable $\alpha$ of the heating temperature T to zero as the count of recording sheets S exceeds a first threshold of, for example, 300, and maintains the heating temperature T at the original, reference value Tref as the count of recording sheets S exceeds a second threshold of, for example, 600.

Such arrangement allows for maintaining a stable fixing performance regardless of the number of recording sheets processed successively in the fixing device 20, as it reduces the risk of excessively heating the fuser roller 23, which can absorb substantial amounts of heat from the fuser belt 24 entrained therearound during an extended period of operation.

In still further embodiments, it is also possible that the controller 100 causes the fixing device 20 to enter an idle state where the first temperature t1 detected falls below a secondary threshold temperature lower than a primary threshold temperature against which the first temperature t1 is compared to determine whether to raise the heating temperature T.

Specifically, for example, in heating temperature adjustment, the controller 100 may determine whether the first temperature t1 detected falls below a relatively low, secondary threshold temperature of, for example, 35° C. Where the secondary threshold is exceeded, the controller 100 causes the fixing device 20 to enter an idle state, in which the fuser roller 22 rotates without processing a recording sheet while absorbing heat from the fuser belt 24 heated by the heat roller 23, causing its metal core 29 to gradually accumulate heat. Such idling of the fixing device 20 may continue until the first temperature t1 reaches the secondary threshold temperature.

Such arrangement prevents premature execution of a print job where the operating temperature is not sufficiently high, e.g., during operation after an extended period of power-off in a low ambient temperature, typical of a cold winter morning in an office environment, which would otherwise not only cause defects in a resulting image but also damage the fuser belt and contaminate the conveyance rollers with unfixed toner migrating from the recording sheet.

To recapitulate, the fixing device 20 according to this patent specification maintains reliable performance irrespective of changes in environmental and operational conditions through relatively simple heating temperature adjustment, wherein detection of the operating temperature t1 at the metal core 29 of the fuser roller 22 by the first thermometer 101 provides precise indication of heat accumulated in the fuser roller 22, which is fed back to the controller 100 that accordingly performs heating temperature adjustment to allow for a reliable performance of the fixing device 20. The image forming apparatus 1 incorporating the fixing device 20 also benefits from heating temperature adjustment according to this patent specification.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device, comprising:

a heat roller having a surface thereof subjected to heating;

a heater disposed in the heat roller to heat the surface of the heat roller to an adjustable, heating temperature;

a fuser roller disposed parallel to the heat roller and having a surface thereof formed of elastic material deposited on a cylindrical metal core;

an endless, fuser belt looped for rotation around the fuser roller and the heat roller;

a pressure roller disposed opposite the fuser roller with the fuser belt interposed between the pressure roller and the fuser roller, the pressure roller pressing against the fuser roller via the fuser belt to form a fixing nip therebetween, through which a recording medium is conveyed under heat and pressure as the fuser roller and the pressure roller rotate together;

a first thermometer disposed adjacent to the cylindrical core of the fuser roller to detect a first temperature directly at the cylindrical core of the fuser roller; and a controller operatively connected with the heater and the first thermometer to adjust the heating temperature according to the first temperature being detected.

2. The fixing device according to claim 1, wherein the controller raises the heating temperature from an original, reference temperature where the first temperature detected falls below a primary threshold temperature.

3. The fixing device according to claim 2, wherein the controller resets the heating temperature to the reference temperature as an increased number of recording media is successively processed through the fixing nip.

4. The fixing device according to claim 2, wherein the controller idles the fixing device where the first temperature detected falls below a secondary threshold temperature lower than the primary threshold temperature.

5. The fixing device according to claim 1, wherein the controller lowers the heating temperature from an original, reference temperature where the first temperature detected exceeds a primary threshold temperature.

6. The fixing device according to claim 5, wherein the controller resets the heating temperature to the reference temperature as an increased number of recording media is successively processed through the fixing nip.

7. The fixing device according to claim 1, further comprising:

a second thermometer disposed adjacent to the heat roller to detect a second temperature at the surface of the heat roller, wherein the controller is operatively connected with the first and second thermometers to adjust the heating temperature according to a combination of the first and second temperatures being detected.

8. The fixing device according to claim 7, wherein the controller raises the heating temperature from an original, reference temperature where an average of the first and second temperatures detected falls below a primary threshold temperature.

9. The fixing device according to claim 7, wherein the controller lowers the heating temperature from an original, reference temperature where an average of the first and second temperatures detected exceeds a primary threshold temperature.

10. The fixing device according to claim 1, further comprising:

a third thermometer disposed adjacent to the fuser roller to detect a third temperature at the surface of the fuser roller, wherein the controller is operatively connected with the first and third thermometers to adjust the heating temperature according to a combination of the first and third temperatures being detected.

11. The fixing device according to claim 10, wherein the controller raises the heating temperature where an average of the first and third temperatures detected falls below a primary threshold temperature.

12. The fixing device according to claim 10, wherein the controller lowers the heating temperature from an original, reference temperature where an average of the first and third temperatures detected exceeds a primary threshold temperature.

13. The fixing device according to claim 1, wherein the controller performs heating temperature adjustment by adjusting power supply to the heater.

14. The fixing device according to claim 1, wherein the controller performs heating temperature adjustment continuously during execution of a print job.

15. The fixing device according to claim 1, wherein the controller includes a correction table containing one or more threshold temperatures for the first temperature each associated with a specific correction variable, based on which the reference temperature is corrected to obtain an adjusted heating temperature.

16. The fixing device according to claim 1, wherein the heat roller comprises a hollow cylindrical body inside which the heater is accommodated.

17. The fixing device according to claim 1, wherein the heater comprises an infrared radiant heater.

18. A method for use in a fixing device, the fixing device comprising:

a heat roller having a surface thereof heated to an adjustable, heating temperature;

a fuser roller disposed parallel to the heat roller and having a surface thereof formed of elastic material deposited upon a cylindrical core of metal; and an endless, fuser belt looped for rotation around the fuser roller and the heat roller, the method comprising:

detecting a first temperature directly at the cylindrical core of the fuser roller; and adjusting the heating temperature according to the first temperature being detected.

19. An image forming apparatus comprising:

an electrophotographic imaging unit to form a toner image on a recording medium;

a fixing device disposed downstream from the imaging unit to fix the toner image in place on the recording medium, the fixing device comprising:

a heat roller having a surface thereof subjected to heating;

a heater disposed in the heat roller to heat the surface of the heat roller to an adjustable, heating temperature;

a fuser roller disposed parallel to the heat roller and having a surface thereof formed of elastic material deposited upon a cylindrical core of metal;

an endless, fuser belt looped for rotation around the fuser roller and the heat roller;

a pressure roller disposed opposite the fuser roller with the fuser belt interposed between the pressure roller and the fuser roller, the pressure roller pressing against the fuser roller via the fuser belt to form a fixing nip therebetween, through which the recording medium is conveyed under heat and pressure as the fuser roller and the pressure roller rotate together;

a first thermometer disposed adjacent to the cylindrical core of the fuser roller to detect a first temperature directly at the cylindrical core of the fuser roller; and a controller operatively connected with the heater and the first thermometer to adjust the heating temperature according to the first temperature being detected.

* * * * *